US005167130A

United States Patent [19]

Morris, Jr.

[11] Patent Number: 5,167,130

[45] Date of Patent: Dec. 1, 1992

[54] SCREW COMPRESSOR SYSTEM FOR REVERSE CYCLE DEFROST HAVING RELIEF REGULATOR VALVE AND ECONOMIZER PORT

[76] Inventor: William F. Morris, Jr., P.O. Box 1046, Raleigh, N.C. 27602-1046

[21] Appl. No.: 854,077

[22] Filed: Mar. 19, 1992

[51] Int. Cl.[5] ..... F25C 5/10; F25B 41/00

[52] U.S. Cl. ..... 62/196.1; 62/217; 62/278; 62/352

[58] Field of Search ..... 62/352, 196.1, 196.2, 62/196.3, 196.4, 217, 277, 278, 81, 510

[56] References Cited

U.S. PATENT DOCUMENTS

| | | | |
|---|---|---|---|
| 3,769,812 | 11/1973 | Gordon | 62/352 |
| 3,859,814 | 1/1975 | Grant | 62/196.2 |
| 4,094,168 | 6/1978 | Hammer et al. | 62/352 X |
| 4,727,725 | 3/1988 | Nagata et al. | 62/196.3 |
| 4,850,197 | 7/1989 | Taylor et al. | 62/81 |

*Primary Examiner*—Harry B. Tanner
*Attorney, Agent, or Firm*—Mason, Fenwick & Lawrence

[57] ABSTRACT

An economizer arrangement for ice making reverse cycle refrigeration system of the type employing hot-gas defrosting, including a condenser, a receiver to receive liquid refrigerant, a plural tube evaporator having an internal refrigerant chamber in each tube and an expansion valve through which the refrigerant flows into the evaporator tubes during a freezing cycle of the system to cause ice formation on ice-making surfaces of the evaporator means in heat exchange relation with the refrigerant chamber. A rotary screw type compressor supplying to the condenser and has an economizer port at a location along the screw where the pressure builds up to a selected level, a refrigerant valve passes the condenser and routes hot-gas refrigerant during a harvest defrost cycle to the evaporator tubes, and a relief conduit tube communicates the refrigerant chambers of the evaporator tubes with the economizer port. The relief conduit having a relief regulator valve therein set to relieve the pressure being built up in the refrigerant chambers during the defrost cycle to a selected level to provide optimum pressure for ice harvest during defrost by controlling this pressure and transferring most on the refrigeration load of pulling the defrosted circuit back down to normal refrigeration temperatures to the economizer port of the screw compressor.

2 Claims, 2 Drawing Sheets

SCREW COMPRESSOR SYSTEM FOR REVERSE CYCLE DEFROST HAVING RELIEF REGULATOR VALVE AND ECONOMIZER PORT

BACKGROUND OF THE INVENTION

The present invention relates, in general, to reverse cycle-type refrigeration systems, such as thermal storage or ice making apparatus, having a screw compressor and an economizer cycle piping and control arrangement.

In years past, most refrigeration systems were designed to operate at fixed standard design conditions throughout the year in the interest of standardizing such systems with a fixed set of operating conditions so as to minimize the need for adjusting the settings on the various system components. For example, such designs based on fixed standard design conditions were intended to avoid having to adjust the settings on such components as the expansion valves, hand throttling valves, and the various other control and adjusting devices, as well as fixed orifice devices so as to compensate for changes in pressure differentials that might exist if changes in condensing pressure would occur.

More recently, as the cost of electrical power as escalated, the amount of potential savings that could be realized by operating larger refrigeration systems at reduced condensing pressures in ambient conditions would allow it, gained the attention of management, resulting in development of the "economizer cycle" for industrial refrigeration systems which has now become standard in the industry. The normal type of "economizer cycle" would not allow most reverse cycle-type refrigeration systems to function as satisfactory, however, because of the wide range of condensing temperatures and pressures which are encountered, as well as the great variation in heat available in the discharge gas, over the range of operating conditions of the refrigeration system. Many intricate and complicated systems of controls have been designed in an attempt to solve these problems for the various types of reverse cycle applications, but in most cases, at least as many problems have been created as were solved by such designs.

Incorporation of an "economizer cycle" in an ice harvesting-type of thermal storage refrigeration system is particularly desirable because ice harvesting-type refrigeration system applications are particularly "cost conscious," and must be justified in most cases by a relatively quick pay-back.

It is well known in refrigeration today that in industrial refrigeration systems of larger capacity, such as those over 100 tons in size, the best type of compressor to use, from the standpoint of both first cost and efficiency, is a screw-type compressor. In addition, if there is any possible use for a refrigeration load at a slightly higher temperature and pressure than the base load, then the economizer option on a screw compressor can increase both the capacity and efficiency of the screw compressor even further at no loss of base load capacity and at approximately half the brake horsepower per ton of the base load.

When using a hot gas defrost-type arrangement on an ice maker or thermal storage ice harvester to defrost the ice from the ice making surfaces, it is desirable to warm up the ice making surfaces to an optimum temperature for quick defrost and then after the ice is harvested, to pull the ice making surfaces back down to the ice making range again as quickly as possible in order to have as much time during the total cycle dedicated to making ice as possible, and a minimum time spent in harvest or reverse cycle mode in which heat is being pumped back into the ice making surfaces. In fact, for each second of time that can be subtracted from the defrost cycle, the equivalent of adding two seconds to the refrigeration mode of the cycle is achieved. To accomplish this, it is necessary to control the defrost temperature of the ice making surfaces to the optimum for fastest ice harvest in order to minimize ice meltage of the ice already made, as well as to set a maximum temperature to which the ice making surfaces that have already dropped their ice first will increase to, while the remainder of the ice is being harvested.

An object of the present invention is the provision of a reverse cycle-type refrigeration system, such as an ice maker or thermal storage ice harvester, wherein the maximum temperature that the ice making surfaces warm up to during the defrost or harvest mode is controlled by controlling the maximum pressure to which the hot gas builds up in the evaporator during harvest, this being done by relief regulator valve means set to relieve this pressure build up in the evaporator to an optimum pressure for best harvest time, and relieve the pressure regulator valve into the economizer port of the screw compressor.

Another object of the present invention is the provision of a novel piping and control arrangement for reverse cycle refrigeration systems as described in the immediately preceding paragraph, wherein the hot gas relieved by the relief regulator valve into the screw compressor accomplishes part of the load cycle at no penalty to the base capacity of the screw compressor. This enables one to control the defrost pressure during harvest and also provides most the pulled-down refrigeration capacity after harvest at no expense or load to the base capacity of the compressor at the main suction valve, thereby increasing both the capacity and efficiency of the system. An additional advantage is realized from this arrangement, in that it eliminates the sudden surge of pressure from the circuit being defrosted upon the opening of the suction stop valve, as well as the normal tendency of this sudden release of high pressure to carry slugs of liquid along with the gas which might cause "hydraulic hammer" to the piping and mechanical damage to the compressor.

Other objects, advantages and capabilities of the present invention will become apparent from the following detailed description, taken in conjunction with the accompanying drawings illustrating a preferred embodiment of the invention.

DETAILED DESCRIPTION OF THE PREFERRED EMBODIMENTS

Figure 1A:
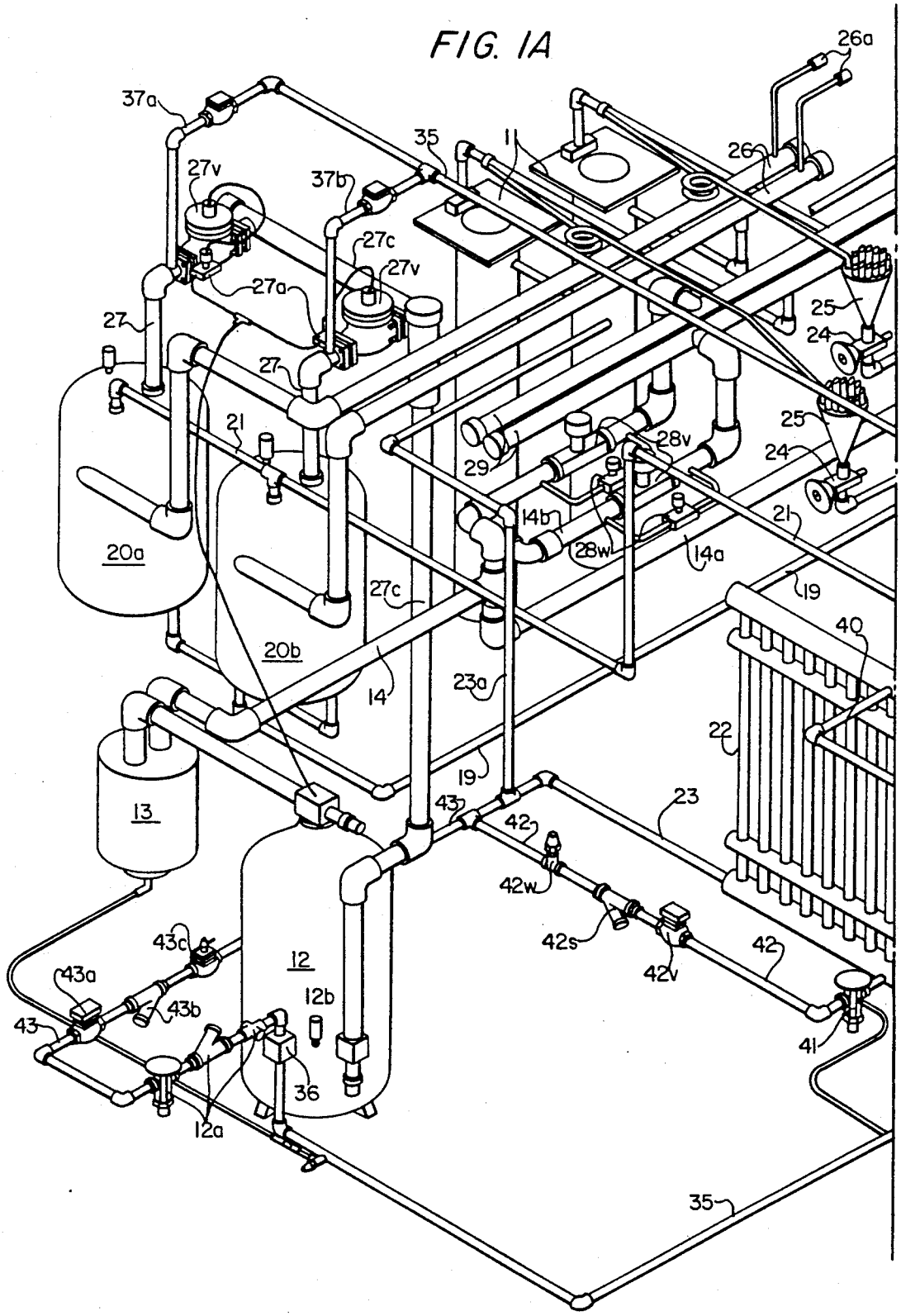
FIG. 1A and 1B collectively form, when joined along lines A—A and B—B, a diagrammatic perspective illustration of a reverse cycle type refrigeration system of this screw compressor type having evaporator tubes for formation of ice thereon and a gas defrost type harvesting arrangement, together with an economizer cycle piping and control arrangement embodying the present invention.
Figure 1B:
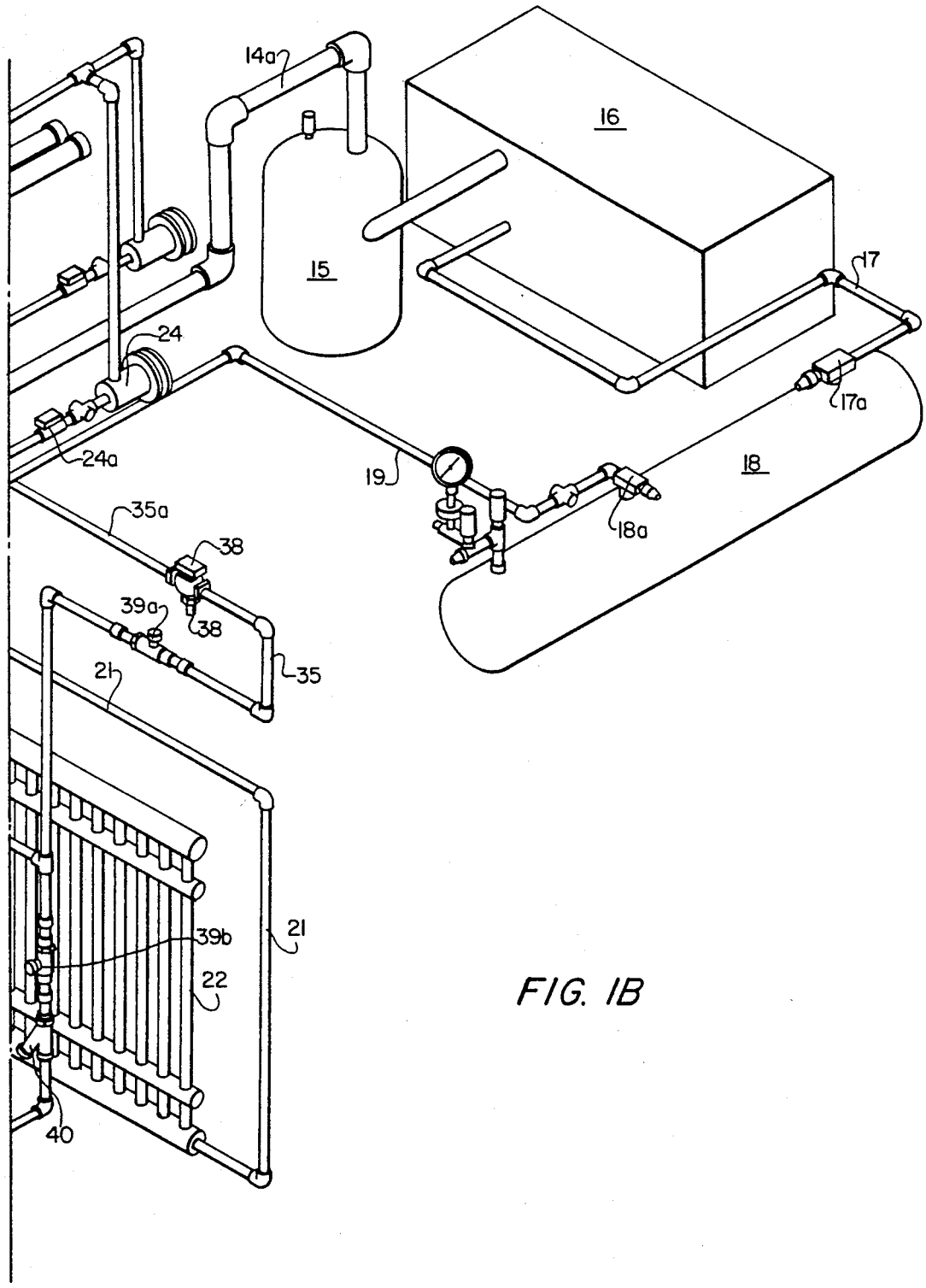

Referring to the drawings, wherein like reference characters designate corresponding parts throughout the figures, there is illustrated in FIGS. 1A and 1B a schematic diagram of a reverse cycle defrost ice maker refrigeration system wherein ice is formed on the exterior surfaces of a plurality of ice maker evaporators, for example elongated tube evaporators, two of each are shown at 11, which may be similar to the types disclosed in the C. E. Lowe U.S. Pat. Nos. 3,820,585; 3,026,686; or 3,034,310. The evaporator tubes 11 during the freezing cycle form ice on the interior and exterior surfaces thereof, and, during the hot gas defrost cycle, the ice is gravationally discharged into a trough and moved by a conveyor such as screw conveyor (not shown) to a discharge station or ice storage station, in a manner similar to that described in the above identified Lowe patents. The refrigeration system includes a compressor 12 for supplying hot gas refrigerant through an oil separator 13, to a refrigerant line 14 and through the lower branch 14*a* to a gas conditioner 15 (regarding U.S. Pat. No. 4,719,766) connected to an air cooled condenser 16 where the refrigerant is condensed to a liquid state by heat exchange with cooling air or water brought into heat exchange relationship with the hot gaseous refrigerant flowing into the condenser 16. The liquid refrigerant is then supplied through refrigerant line 17 having a shut-off valve 17*a* therein, to the receiver 18. The condensed liquid refrigerant exits from receiver 18 through valve 18*a* and conduit system 19 to the boil-out coil in the bottom of suction accumulator tanks 20*a*, 20*b* in the illustrated embodiment. Conduit 21 connected from the boil-out coil exits the upper region of the suction accumulator tanks 20*a*, 20*b* leads the liquid refrigerant to a refrigerated sub-cooler 22, from which the liquid refrigerant is led by conduit 23 and branch 23*a* thereof, to the expansion valves 24 and distributors 25 supplying refrigerant to the hollow annular interior refrigerant chambers in the evaporator tubes 11. A liquid moisture indicator 24*a* and liquid filter drier are provided in each of the conduits to the expansion valves 24. Water fed to the water discharge ports or outlets (not shown) at the upper exterior of the evaporator tubes supply water onto the inner and outer evaporator tube surfaces to be frozen by heat exchange relationship with the refrigerant in the evaporator tubes in a manner well known in the art.

Suction headers 26 are connected to the upper portions of the evaporator tubes 11 to receive gaseous refrigerant which is evaporated during the ice freezing process and conduct it to the suction accumulators 20*a*, 20*b* having outlet conduits 27 leading from the suction accumulators which have pilot solenoid valves 27*a* controlling suction stop valves 27*v* and are then joined by a single conduit 17*c* including a suction filter 27*f* to provide return of the gaseous refrigerant to the compressor 12 to again be compressed and recycled through the system. Hot gas valves 28*v* and hot gas bypass valves 28*w* are provided in the upper branch conduits 14*b* of conduit 14 to connect the hot gas headers 29 to oil separator 13 and the compressor hot gas outlets.

As is well known in the art, during the normal ice making cycle liquid refrigerant compressed by the compressor 12 is supplied to the air or water cooled condenser 16 where the refrigerant is condensed to liquid state by heat exchange with the surrounding air or water and is supplied to the receiver 18, and from the receiver 18 passes through the appropriate piping to the liquid expansion valves 24 to the interior refrigerant chambers of the evaporator tubes 11 to freeze the water distributed on the exterior surfaces of the ice forming evaporator tubes 11.

When the controller for cycling the system between freezing and harvesting cycles is activated in the usual manner supply of liquid refrigerant from the receiver 18 to the evaporator tubes is terminated and hot gaseous refrigerant is bypassed directly from the compressor 12 to the hot gas headers 29 which frees the ice formed on the exterior surfaces of the evaporator tubes 11 to be gravity discharged into the usual conveyor or other collecting receptacle for the ice.

To effect incorporation in the ice-harvesting-type of thermal storage refrigeration system such as described above, a piping and control arrangement is provided so as to achieve control of the defrost temperature of the ice making surfaces to the fastest ice harvest in order to minimize ice meltage of the ice already made as well as to set a maximum temperature to which the ice making surfaces that have already dropped their ice first will increase while the remainder of the ice is being harvested. The maximum temperature that the ice surfaces warm up to during defrost or harvest mode is controlled by controlling the maximum pressure to which the hot gas can build up to in the evaporator during harvest. In the described embodiment, this is done by means of a "relief regulator valve" that is set to relieve pressure being built up in the evaporators to the optimum pressure for best harvest time. By relieving this relief valve into the economizer port of the screw compressor, this part of our load cycle is accomplished at no penalty to the base capacity of the screw compressor.

Referring to the drawings, a relief conduit 35 is provided extending from the outlet conduits 27 joining the suction accumulators to the economizer port, indicated at 36, of the screw compressor 12. As will be understood by those skilled in the refrigeration art, the economizer port on screw compressors is a port provided on the screw compressor at a point along the screw where the pressure is built up far enough so feedback internally to the suction inlet will not occur. The end of the relief conduit 35 nearest the suction accumulators 20*a*, 20*b* is provided with two branch lines or piping 37*a*, 37*b*, joining the suction accumulator outlet conduits 27 adjacent the pilot solenoid valves 27*a* with check valves 37*v* in the lines 37*a*, 37*b*, and has the relief regulator valve, indicated at 38, in the upper horizontal portion 35*a*, as shown in FIG. 1B. The conduit 35 also includes a first shut-off valve 39*a* between the relief regulator valve 38 and a branch conduit 40 connecting to the upper portion of the sub-cooler 22, and another second shut-off valve 39*b* and strainer 40 below the juncture with branch conduit 40. The relief conduit 35 then continues to the compressor 12 where it connects to the economizer port 36, and includes a connection to an expansion valve 41 in a conduit 42 having a solenoid valve 42*v*, strainer 42*s* and shut-off value 42*v* therein connecting to the conduit 23 leading from the outlet of the sub-cooler 22. Also associated with the screw compressor 12 are a liquid moisture indicator, strainer and expansion valve, indicated collectively at 12*a* and a relief valve 12*b* furnished with the compressor, and a conduit 43 having a solenoid valve 43*a*, strainer 43*b*, and shut-off valve 43*c*, as shown, connects between the economizer port and the conduit 23 from the sub-cooler 22.

With the relief regulator valve 38 set to relieve the pressure being built up by the hot gas in the annular refrigerant chambers of the tube evaporators 11 to the optimum pressure for best harvest, as determined by the installer or operator, the connection to the economizer port 36 of the screw compressor 12 relieves the evaporator pressure during harvest by controlling this pressure and transferring most of the refrigeration load of pulling the defrosted circuit back down to normal refrigerating temperatures to the economizer port 36 of the screw compressor 12 rather than to have this load thrown upon the basic suction capacity of the compressor.

I claim:

1. A reverse cycle refrigeration system of the type employing hot-gas defrosting, including a condenser, a receiver to receive liquid refrigerant therefrom, evaporator means of the plural vertical tube or plate type having inner and outer cylindrical ice-forming surfaces and a refrigerant chamber between said surfaces for refrigerant from the receiver, expansion valve means through which the refrigerant flows into the evaporator during a freezing cycle of the system to cause ice formation on the ice-making surfaces in heat exchange relation with the refrigerant chambers, a suction accumulator, a suction header receiving gaseous refrigerant from the evaporator tubes and conducting it to the suction accumulator, a rotary screw type compressor for receiving hot-gas refrigerant from the evaporator means through a suction conduit connected to the compressor and for supplying refrigerant through an outlet conduit to the condenser to form liquid refrigerant therein, the screw compressor having an economizer port at a location along the screw where the pressure builds up to a selected level, refrigerant valve means for by passing the condenser and routing hot-gas refrigerant during a harvest defrost cycle, and relief regulator and conduit means communicating the refrigerant chamber of the evaporator means with the economizer port of the screw compressor, the relief conduit having a relief regulator valve therein set to relieve the pressure being built up in the refrigerant chamber during the defrost cycle to a selected level to provide optimum pressure for ice harvest during defrost by controlling this pressure and transferring most o the refrigeration load of pulling the defrosted circuit back down to normal refrigeration temperatures to the economizer port and screw compressor.

2. A reverse cycle ice-maker refrigeration system of the type employing hot-gas defrosting, including a condenser, a receiver to receive liquid refrigerant therefrom, evaporator means of the plural vertical tube or plate type having inner and outer cylindrical ice-forming surfaces and a refrigerant chamber between said surfaces for refrigerant from the receiver, expansion valve means through which the refrigerant flows into the evaporator means during a freezing cycle of the system to cause ice formation on the ice-making surfaces in heat exchange relation with the refrigerant chambers, a suction accumulator, a suction header receiving gaseous refrigerant from the evaporator tubes and conducting it to the suction accumulator, a rotary screw type compressor for receiving hot-gas refrigerant from the suction accumulator connected to a compressor inlet port and for supplying refrigerant through an outlet conduit to the condenser to form liquid refrigerant therein, the screw compressor having an economizer port at a location along the screw where the pressure builds up to a selected level, refrigerant valve means for bypassing the condenser and routing hot-gas refrigerant to the refrigerant chambers of the evaporator tubes during a harvest defrost cycle, and relief conduit means communicating the refrigerant chambers of the evaporator means through the suction accumulator with the economizer port of the screw compressor, the relief conduit having a relief regulator valve therein set to relieve the pressure being built up in the refrigerant chamber during the defrost cycle to a selected level to provide optimum pressure for ice harvest during defrost by controlling this pressure and transferring most on the refrigeration load pulling the defrosted circuit back down to normal refrigeration temperatures to the economizer port and screw compressor.

* * * * *